United States Patent [19]

Bikales

[11] Patent Number: 4,476,663

[45] Date of Patent: Oct. 16, 1984

[54] STRUCTURE WITH COMPOSITE MEMBERS

[76] Inventor: Victor W. Bikales, 7301 Mission Rd., 326A, Shawnee Mission, Kans. 66208

[21] Appl. No.: 523,372

[22] Filed: Aug. 15, 1983

[51] Int. Cl.[3] ..... E04C 3/30

[52] U.S. Cl. ..... 52/730; 144/350

[58] Field of Search ..... 52/729, 730; 156/264; 144/345, 346, 350

[56] References Cited

U.S. PATENT DOCUMENTS

| | | | |
|---|---|---|---|
| 186,893 | 1/1877 | Springer . | |
| 323,424 | 8/1885 | Jackson | 52/729 |
| 432,640 | 7/1890 | Philbrick . | |
| 1,504,616 | 8/1924 | Gary . | |
| 1,732,743 | 10/1929 | Dougherty . | |
| 3,141,206 | 7/1964 | Stephens | 52/406 |
| 3,654,741 | 4/1972 | MacDonell | 52/730 |
| 3,961,654 | 6/1976 | Hasenwinkle . | |
| 3,989,078 | 11/1976 | Hasenwinkle . | |
| 4,111,247 | 9/1978 | Hasenwinkle . | |
| 4,122,878 | 10/1978 | Kohn . | |
| 4,262,717 | 4/1981 | Kohn . | |
| 4,355,754 | 10/1982 | Lund et al. . | |

FOREIGN PATENT DOCUMENTS

| | | | |
|---|---|---|---|
| 571021 | 2/1959 | Canada . | |
| 80770 | 9/1951 | Czechoslovakia | 52/730 |
| 2404898 | 8/1975 | Fed. Rep. of Germany | 144/346 |
| 378524 | 6/1964 | Switzerland | 144/346 |
| 781627 | 8/1957 | United Kingdom . | |

*Primary Examiner*—Henry E. Raduazo

*Attorney, Agent, or Firm*—Litman, Day & McMahon

[57] ABSTRACT

A structure is formed with a beam, floor and ceiling joists, studs, top and bottom plates, rafters and headers consisting of composite wooden members. The composite wood members include aligned pairs of elongated pieces, each piece including a narrow face, a wide face and a pair of radial faces. The faces extend longitudinally in relation to the piece. The pieces are bonded together at their narrow faces between the wide faces. The transverse cross-sectional geometry of each piece comprises a trapezoid with an apex side at the narrow face, a base side at the wide face and a pair of radial sides; each radial side being associated with a respective radial face. The members may be formed with pairs of tapered pieces oriented in opposite relation with respect to each other. A method of producing the composite wooden member includes the steps of radially cutting a log into a plurality of sector-shaped segments; longitudinally cutting each segment at its apex to form a narrow face and longitudinally cutting each segment at its chord to form a wide face; the resulting elongated piece having a trapezoidal cross-section. Adhesive is applied on one of the narrow faces and the elongated pieces are clamped together with their narrow faces together in mutually opposing relationship to produce the composite wood member.

12 Claims, 10 Drawing Figures

Fig. 1.
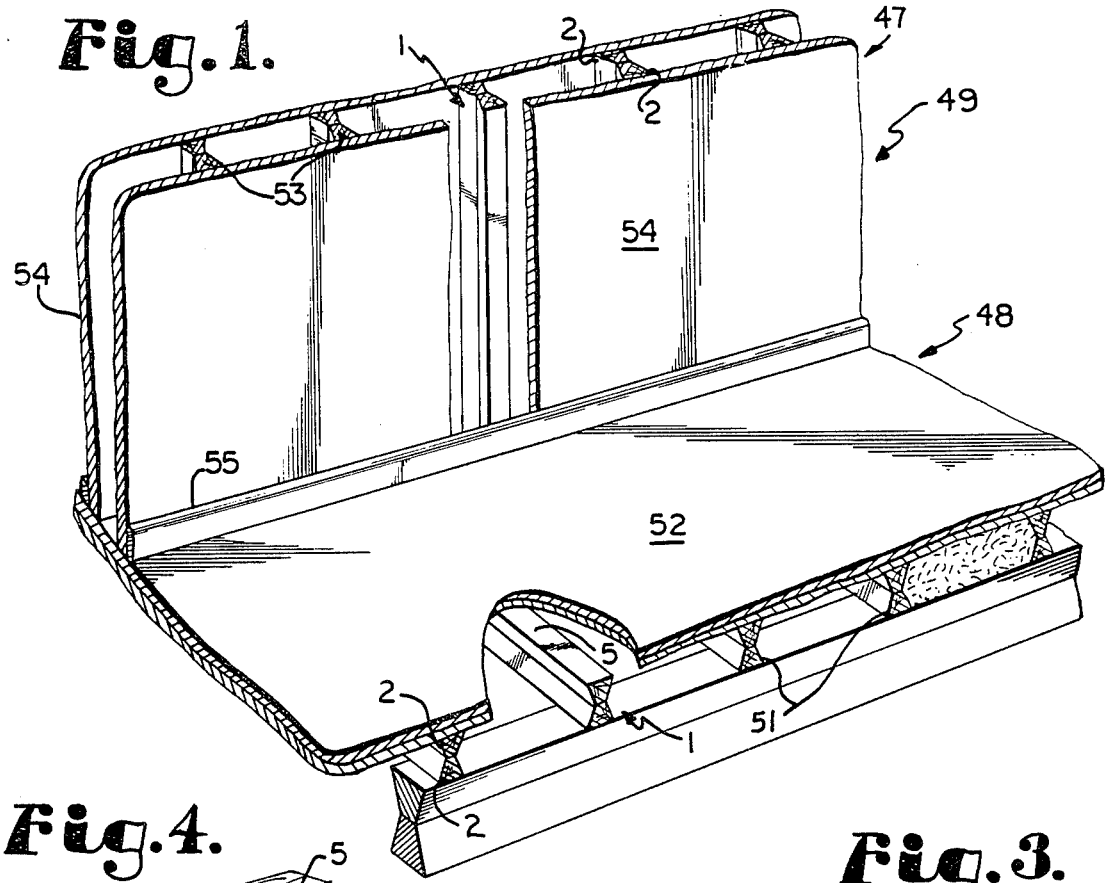
Fig. 4.
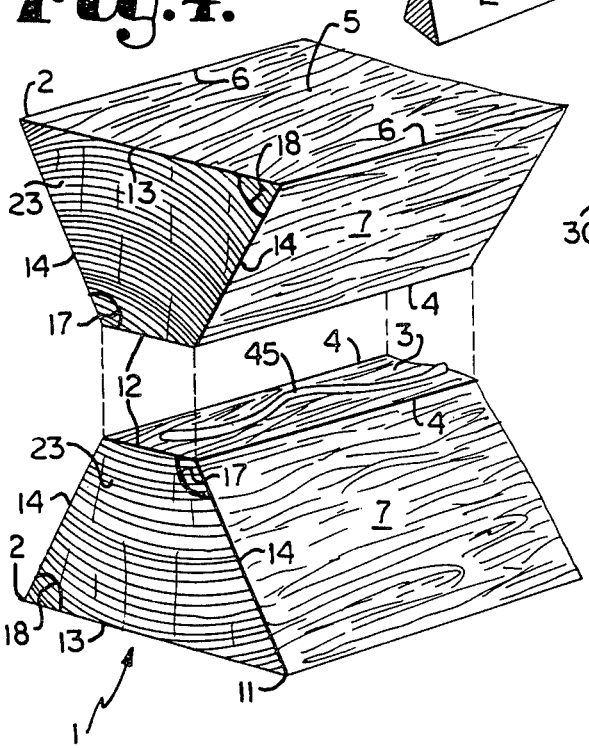
Fig. 3.
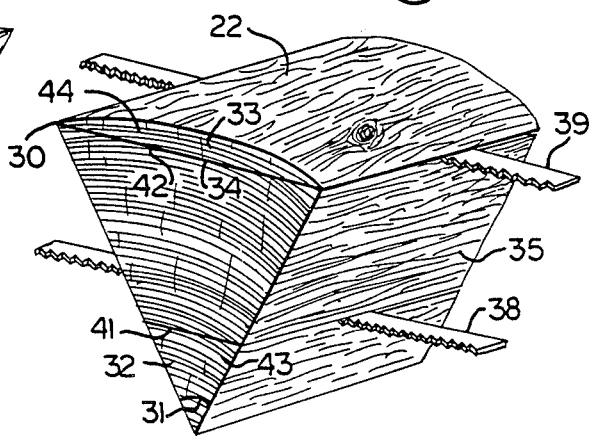
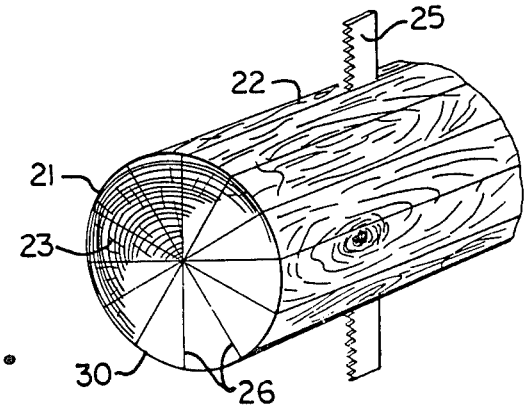
Fig. 2.

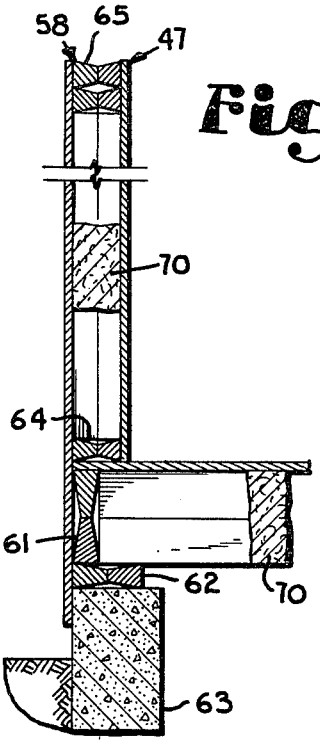
Fig. 1a.
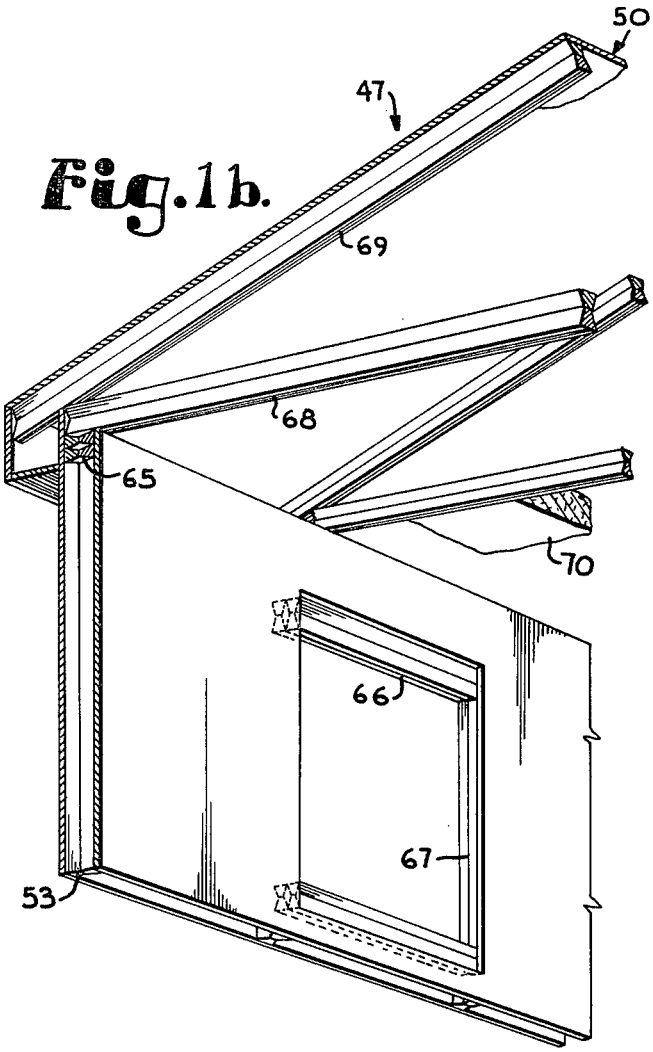
Fig. 1b.
Fig. 6.
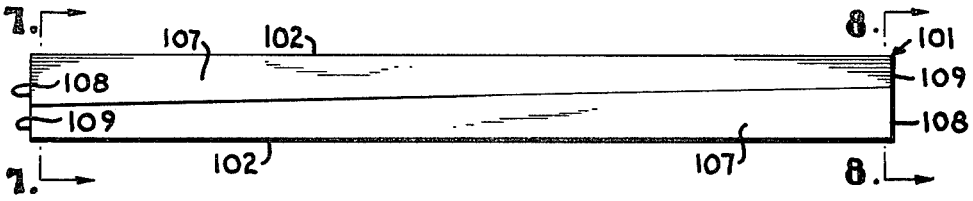
Fig. 7.
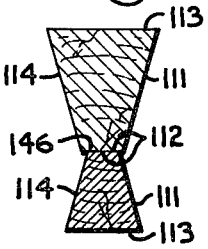
Fig. 5.
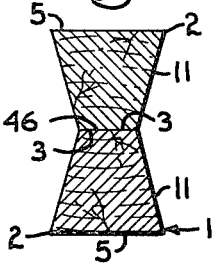
Fig. 8.
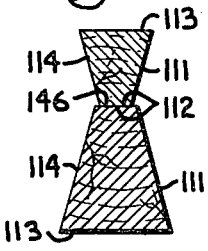

STRUCTURE WITH COMPOSITE MEMBERS

BACKGROUND OF THE INVENTION

The present invention relates to wood structures and in particular to a structure formed with composite wood members including aligned pairs of elongated pieces each having a trapezoidal cross-sectional geometry, a narrow face and a wide face. The narrow faces of the pieces are bonded together in mutually opposing or abutting relationship between the wide faces. The composite wood member is more efficient to produce and more efficient structurally than comparably sized boards having rectangular cross-sectional configurations and may be used in place of such boards in many applications. The present invention also relates to a method of producing composite wood members from logs with minimal waste and maximum yield.

In the lumber field, wood structural members or boards having rectangular cross-sectional configurations and comprising a single piece cut from a log are well known. Such members or boards are generally designated by their nominal cross-sectional dimensions rounded off to the next largest inch although the actual finished dimensions after milling and drying are less. For example, boards commonly designated as 2×4's have nominal cross-sectional dimensions of two inches and four inches and actual cross-sectional dimensions of approximately one and one-half inches and three and one-half inches. Such 2×4 boards of appropriate length may be placed vertically at a predetermined spacing as studs within wall structures with other materials attached to their one and one-half inch wide opposite faces to form walls. Also, boards with nominal cross-sectional dimensions of, for example, two inches and ten inches (2×10's) may be placed horizontally in various structures to support finished floor surfaces on their upper one and one-half inch wide faces. As a further example of common uses for such boards, rafters comprising boards with nominal cross-sectional dimensions of two inches and six inches (2×6's) may be tilted to an appropriate angle to support a roof structure. Thus, for a typical wood-frame structure, several sizes of boards may be utilized for different portions thereof.

Such wood members having rectangular cross sections and comprising a single piece cut from a log, however, have several significant drawbacks. A prior art method of cutting the log to produce such boards involves feeding it lengthwise through a saw a number of times with the cuts being substantially parallel or perpendicular with respect to each other. Using this method, solid wood slabs or edgings comprising areas adjacent the log's cylindrical or frusto-conical outer surface remain after sawing out the boards and are generally suitable only for processing into fuel, particle board, wood pulp and the like, all of which products are less valuable on a per volume of wood basis than boards usable as wood structural members. Such slabs or edgings, together with those portions of the log consumed in the saw kerfs, may account for as much as forty to fifty percent of the wood volume in a particular log. In relatively small-diameter logs, such portions may account for even higher percentages of the total wood volume thereof. Therefore, this represents a relatively wasteful and inefficient method of producing wood members.

Another problem with producing such boards from logs is that maximum utilization of the total wood volume thereof often requires producing boards with different cross-sectional dimensions. For example, a log of given diameter might yield only a few 2×8's, along with 2×6's and 2×4's. Also, correspondingly larger logs are required for the production of the relatively larger boards. Therefore, boards having larger cross-sectional dimensions command higher prices per board foot than boards with smaller cross-sectional dimensions.

Furthermore, the available trees for milling into rectangular boards are generally expected to have smaller average diameters due to the fact that smaller diameter trees generally reappear in wooded areas after harvesting and reforestation. Therefore, maximizing the percentage yield of usable lumber from remaining forests is particularly important.

In addition to being relatively inefficient to produce, boards with rectangular cross-sections are structurally relatively inefficient. In use as structural framing members, boards are selected and placed as required to resist loads acting against the structure. Thus, 2×4's used as wall studs are sized and spaced as required to support overlying portions of the structure and to maintain the wall in a substantially straight, upright position by resisting lateral forces and any tendency of the wall to buckle under compressive loads placed thereon. Roof rafters and floor joists, on the other hand, are generally placed horizontally or at an angle from the vertical and are primarily subjected to bending loads acting downwardly thereon. To obtain maximum utilization of the strength in such rafter and joist members, faces thereof with longer cross-sectional dimensions are aligned vertically. For example, a 2×10 used as a floor joist would be placed with its nominal two inch wide faces horizontal and its nominal ten inch wide faces vertical.

When subjected to a bending load from above, a horizontally aligned board is subjected to compression forces in the upper half of its section modulus and tensile forces in the lower half of its section modulus. At approximately the center of a section modulus of a given structural member subjected to such a bending load, the tensile and compressive forces substantially cancel each other out and equal zero. However, the section modulus center is subjected to a longitudinal shear force caused by the opposite-acting compressive and tensile forces in its upper and lower halves respectively. Boards with rectangular cross-sections are structurally relatively inefficient because they have substantially the same transverse, cross-sectional width between their opposite upper and lower faces. Thus, while the upper and lower faces of such a member are respectively subjected to the maximum compressive and tensile forces, portions therebetween having the same width as the upper and lower faces are oversized for the lesser forces to which they are subjected. Therefore, efficient structural members designed for bending loads, unlike conventional boards, should have significantly less transverse cross-sectional widths between their opposite faces at which the maximum tensile and compressive forces occur.

Yet another disadvantage of conventional boards having rectangular cross sections is their susceptibility to cupping and warping due to the orientation of their faces with respect to the grain patterns of the logs of which they are comprised. The cross-sectional grain patterns of logs comprise pluralities of concentric annular rings. The orientation of the faces of a wooden member with respect to such annular rings is significant because wood tends to shrink approximately twice as much in a direction tangential to the annular rings, as noted in the "Wood Handbook" (Agricultural Handbook No. 72) published by Forest Products Laboratory of the U.S. Department of Agriculture (August, 1974). Wood member faces oriented tangentially to the annular rings are referred to as comprising flat grain, and wood member faces radially or perpendicularly oriented with respect to the annular rings are referred to as comprising vertical grain. Cupping and warping are caused by different amounts of shrinkage with respect to different portions of a wood member. Because even kiln drying removes only a portion of the moisture contained in green wood, the shrinking process can continue for a considerable period of time, even after incorporation of a wood member into a structure. This further shrinking can result in damage to the structure, for example, by causing finished walls to crack and doors and windows to bind.

The process by which conventional boards are sawn from logs generally results in at least several of their respective faces comprising flat grain wood and therefore being subject to relatively large amounts of shrinkage. Such boards are therefore particularly susceptible to cupping and warping for that reason and also because of the likelihood of different amounts of shrinkage across respective opposite faces.

The composite member of the present invention, on the other hand, is considerably less susceptible to warping and cupping than conventional boards having rectangular cross sections because of the orientation of the faces of its pieces with respect to the grain pattern of the wood. The radial faces of the pieces comprise vertical grain and are thereby subjected to relatively small amounts of shrinkage. Although the narrow and wide faces comprise flat grain and are therefore subject to larger amounts of shrinkage, because they are positioned opposite with respect to each other, such shrinkage amounts will be proportionately about the same and tend to cancel each other out. Also, the vertical grain radial faces of many such pieces will be wider than both the narrow and wide flat grain opposite faces thereof and the warping effect of the flat grain shrinkage will thus be minimized with respect to such pieces.

The composite member of the present invention also tends to resist cupping and warping because the arcuate cross-sectional grain patterns of the pieces are concave with respect to their narrow faces. Thus, when the pieces are bonded together with their arcuate grain patterns oriented opposite with respect to each other, the cupping and warping tendencies of the pieces will tend to cancel each other out.

Conventional boards often include knots, disease damage and sappy portions which are more likely to comprise a significant portion of a one-piece board than of a composite member wherein the effects of such flaws in the individual pieces tend to be minimized with respect to the composite member as a whole.

SUMMARY OF THE INVENTION

In the practice of the present invention, a structure is provided with composite wood members which are structurally more efficient than comparably sized boards having rectangular cross-sections. The composite members can be cut from cylindrical or frusto-conical logs with minimum waste. Each member has a pair of elongated pieces; each piece having a narrow face, a wide face and a pair of radial faces. The narrow faces are bonded together in mutually opposing or abutting relationship between the opposite wide faces. The member is formed by radially cutting a log into a plurality of sector-shaped segments, longitudinally cutting each segment at its apex and its outer arcuate region to form a piece having a narrow face and a wide face. Adhesive is applied to at least one of the narrow faces. The pieces are then longitudinally aligned with their wide faces positioned on opposite sides of the member and their narrow faces positioned between the wide faces in abutting relation.

Therefore, the objects of the present invention are: to provide a structure with composite members; to provide a composite wood member which may be used in place of a comparably-sized one piece board having a rectangular cross-sectional configuration; to provide such a member which may be cut from cylindrical or frusto-conical logs with minimum waste; to provide such a member which may be produced in large numbers from relatively small diameter logs; to provide such a member which may be produced in larger quantities from logs of equivalent diameter than comparable boards having rectangular cross sections; to provide such a member having greater structural efficiency than comparably sized one-piece boards having rectangular cross sections; to provide such a member comprising a pair of elongated pieces each having a trapezoidal cross section; to provide such a member wherein each elongated piece has a narrow face and a wide face, said narrow faces being bonded together between the opposite wide faces; to provide such a member wherein each piece has a pair of radial faces; to provide such a member wherein each piece has an arcuate cross-sectional grain pattern concave with respect to its narrow face; to provide such a member wherein the orientation of the grain pattern tends to maintain dimensional stability of the composite member and resist warping and cupping thereof; to provide such a member wherein defects in logs from which the pieces are cut are randomized with respect to the entire member; to provide such a member which may be produced in a variety of different sizes; to provide a method of producing such a member whereby logs are radially cut into sector-shaped segments; to provide such a method for producing a greater quantity of such members having the same cross-sectional dimensions from an equivalent volume of wood than is possible for comparably sized boards having rectangular cross sections; to provide such a method of producing such members having greater structural strength than conventional boards with rectangular cross sections having equivalent volumes of wood; to provide such a member which is economical to manufacture, efficient in use; capable of a long operating life, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a fragmentary perspective view of a structure including a plurality of composite wood members according to the present invention.

FIG. 1*a* is a fragmentary, cross-sectional view of the structure.

FIG. 1*b* is a fragmentary, perspective view of the structure.

FIG. 2 is an enlarged, fragmentary perspective view of a log being longitudinally cut and showing cut lines for producing a plurality of sector-shaped segments from the log.

FIG. 3 is an enlarged, fragmentary perspective view of a sector-shaped segment of a log particularly showing cut lines and longitudinal cuts being made at the apex and outer arcuate areas of the segment.

FIG. 4 is an enlarged, fragmentary perspective view of a pair of elongated pieces showing adhesive applied to a narrow face of one piece prior to clamping against a narrow face of the other piece.

FIG. 5 is a transverse, cross-sectional view of a composite wood member according to the present invention.

FIG. 6 is a side elevational view of a modified embodiment of a composite wood member according to the present invention.

FIG. 7 is a transverse, cross-sectional view of the modified wood member taken generally along line 7—7 in FIG. 6.

FIG. 8 transverse, cross-sectional view of the modified wood member taken generally along line 8—8 in FIG. 6.

DESCRIPTION OF THE PREFERRED EMBODIMENT

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

For purposes of description herein, the terms "upper", "lower", "vertical", "horizontal", and derivatives thereof shall relate to the invention as oriented in FIG. 1, however, it is to be understood that the invention may assume various alternative orientations, except where expressly specified to the contrary.

Referring to the drawings in more detail, the reference numeral 1 generally designates a composite wood member including an aligned pair of elongated pieces 2. Each piece 2 has a narrow face 3 with edges 4 and a wide face 5 positioned opposite the narrow face 3. Each wide face 5 has edges 6. A pair of opposite radial faces 7 extend between narrow face edges 4 and corresponding wide face edges 6. The faces 3, 4 and 7 each extend longitudinally with respect to the elongated piece 2.

As shown in FIG. 5, each elongated piece 2 has a cross-sectional geometry comprising an isocelese trapezoid 11. The trapezoid 11 includes an apex side 12 at the narrow face 2 and a base side 13 at the wide face 5 of the elongated piece 2 and a pair of opposite radial sides 11 each at a respective radial face 7. At the intersection of the apex side 12 and the radial sides 14 obtuse included angles 17 are defined within the trapezoid 11 at the narrow face edges 4. The trapezoid 11 also has acute included angles 18 at the intersections of the base side 13 with the radial sides 14 at the wide face opposite edges 6.

To produce the composite wood member 1 according to the method of the present invention, suitable harvested logs such as that shown at 21 are selected upon such standards as grade and size. The selected logs 21 are then cross-cut to a predetermined length corresponding to the desired finished length of the composite wood members 1 to be produced. The aforementioned steps may be automatically carried out by equipment known in the lumber manufacturing industry as a "merchandiser" for high-speed production. An automatic merchandiser may, for example, size and grade the logs 21, cross-cut them to the desired length and sort them according to grade and size.

The graded, sized and cross-cut logs 21 may then be machined at their outer surfaces 22 to remove an amount of bark and wood as necessary to round the logs 21 to a cylinder or a right frustum of a cone using machinery such as, for example, a lathe knife. To machine a log 21 to a cylindrical shape, it is generally necessary to remove a volume of wood representing a taper of the log 21. However, the practice of this invention provides for the utilization of portions of the taper volume of such a frusto-conical log which normally comprise waste. The step of machining the outer surface 22 of a log 21 may be eliminated altogether from the method of producing the composite wood members 1 because the method requires a further cutting step to produce the elongated pieces 2 whereby the bark and outer surface 22 could also be removed.

As shown in FIG. 2, the logs 21 are run lengthwise through a saw such as the band saw 25 shown and radially cut at cut lines 26. Each sector-shaped segment 30 has a cross-sectional geometry including an apex angle 31, an apex region 32 and an arcuate region 33 with a chord 34 at the base of the arcuate region 33. Each sector-shaped segment 30 also includes a pair of radial faces 35 formed by the lengthwise cuts along radial cut lines 26.

The log 21 cut as shown in FIG. 2 will yield 12 sector-shaped segments 30. However, in the practice of the present invention, the number of such longitudinal cuts may be varied to produce a desired number of sector-shaped segments 30 having predetermined cross-sectional dimensions and included angles 17 and 18. Also, every sector-shaped segment 30 being thus cut from the log 21 is not required to have the same cross-sectional dimensions. For example, the log 21 may be sawn into several relatively wide sector-shaped segments 30 for the production of composite members 1 having nominal dimensions of four inches across their wide faces 5 and also several relatively narrow sector-shaped segments 30 for the production of composite members 1 having nominal dimensions of two inches across their wide faces 5. Each sector-shaped segment 30 is then run lengthwise through a band saw 38 along a cut line 41 to remove the apex region 32 and a band saw 39 along a cut line 42 at the chord 34 to remove the arcuate region 33 (FIG. 3). The sawn-off apex and arcuate regions 32 and 33 respectively are generally not useful for the production of structural wood members and are therefore used as fuel or ground up into chips for particle board and the like.

In the practice of the present invention, the regions 32 and 33 and those portions of the log 21 in the saw kerf along cut lines 26, 41 and 42 represent substantially all of the waste wood produced in manufacturing of the composite wood member 1. This method of cutting the log 21 contrasts with prior art wood production techniques where significantly larger percentages of the wood volume in a log are wasted in the production of boards having rectangular cross sections. Also, the practice of the present invention provides for efficient utilization of the best parts of the log 21, because the apex and arcuate regions 32 and 33 respectively are generally the portions of the log 21 most likely to have defects and be of a lesser grade. Certain species of trees, for example cypress, typically have centers which are rotted out by disease, decay or insects. In the practice of the present invention the center section is removed as apex region 32 of the segments 30. The arcuate region 33 may include the outer surface 22 comprising the bark of the log 21 and may also include knots where tree branches extended from the log 21. Thus, the composite member 1 of the present invention is comprised as much as possible of the best portions of the wood contained in the log 21.

In assembling the composite wood member 1, a pair of the elongated pieces 2 are selected based upon the desired finished dimensions of the composite wood member 1 to be produced. If the elongated pieces 2 are sawn from logs 21 having the shape of a right cylinder, the opposing narrow faces 3 and opposite wide faces 5 will be substantially identical along the entire length of the resulting composite wood member 1.

In the practice of the present invention, the elongated pieces 2 are preferably dried in a suitable kiln (not shown), for example, a standard dry kiln utilizing hot gas circulating around the elongated pieces 2 in a predetermined manner to remove the excess moisture content therefrom. In contrast to conventional boards having rectangular cross sections, the drying time for the elongated pieces 2 is significantly reduced because the exposed surface area of a pair of the elongated pieces 2 exceeds that of a comparably sized board with a rectangular cross section. Therefore, less fuel is required for kiln drying the wood comprising the composite wood member 1 of the present invention as compared with boards having rectangular cross sections. Preferably, the moisture content of the elongated pieces 2 is reduced to approximately twenty percent or less prior to bonding them together to produce the composite wood member 1. However, the drying step may be eliminated by the use of an adhesive suitable for bonding elongated pieces 2 having a higher moisture content.

As shown in FIG. 4, the narrow faces 3 are bonded together in mutually opposing relationship by any suitable adhesive 45. Clamps (not shown) are applied to the elongated pieces 2 urging their respective narrow faces together as the adhesive 45 cures. The resulting composite wood member 1 has an hourglass shaped cross-sectional configuration as shown in FIG. 5 with the opposed narrow faces 3 positioned between the opposite wide faces 5.

As shown in FIGS. 4 and 5, the elongated pieces 2 are longitudinally aligned and adhesively bonded together at their respective narrow faces 3. The narrow faces 3 abut each other and form a plane of intersection 46 approximately midway between and parallel to respective planes defined by the elongated piece wide faces 15. Any suitable adhesive 45, for example, a phenol-resorcinol-formaldehyde composition, may be applied to one or both of the narrow faces 3. Preferably the adhesive 45 forms an adhesive bond between the elongated piece narrow faces 3 which is stronger than the wood comprising the elongated pieces 2, particularly with respect to resistance to shear loads. A variety of adhesives are well known in the art which are capable of achieving the desired strength in the glue joint at the plane of intersection 46.

A plurality of composite wood members 1 are shown in FIGS. 1, 1*a* and 1*b* as framing members in a structure 47 including a floor structure 48, interior and exterior wall structures 49 and 58 and a roof structure 50. The floor structure 48 includes composite members 1 horizontally positioned in parallel relationship as floor joists 51 and resting at one end on a composite member beam 56. The floor joists 51 support a floor surface 52 on their upper wide faces 5. The interior wall structure 49 includes composite wood members 1 positioned vertically in parallel, spaced relationship with opposite wall surfaces 54 attached to their opposite wide faces 5. Trim members 55 are shown extending horizontally at the intersections of the floor surface 52 and the surfaces 54.

The exterior wall structure 58 includes a rim joist 61 attached to the outer ends of the floor joists 51 and supported by a sill plate 62 resting on a foundation wall 63. The rim joist 61 and the sill plate 62 comprise composite wood members 1 according to the present invention. A composite wood member bottom plate 64 is nailed to the undersides of the wall studs 53 as shown in FIG. 1*a*. The wall structure 58 includes a pair of composite member top plates 65 attached to the tops of the wall studs 53 as shown. A window header 66 is provided over a window opening 67 in the wall structure 49 and comprises a pair of composite wood members 1. (FIG. 1*b*). The roof structure 50 includes horizontally extending composite member ceiling joists 68 and sloping composite member rafters 69 bearing on the top plate 65. Insulation 70, for example fiberglass batt insulation, is placed between the floor joists 51, the wall studs 53 and the ceiling joists 68.

The floor joists 51 are positioned within the floor structure 48 whereby they are primarily loaded by forces acting against their upper wide faces 5. Therefore, loads placed upon the floor surface 52 are transmitted to the floor joists 51 as bending loads acting downwardly in a direction normal to their upper wide faces 5. Such bending loads include a tensile force component acting upon the lower piece 2 and a compressive force component acting upon the upper piece 2 of each floor joist 51. The beam 56, top plates 65, header 66, ceiling joist 68 and rafters 69 are likewise subjected to bending loads acting against their respective wide faces 5.

The composite wood member 1 of the present invention is significantly more efficient structurally than boards with rectangular cross sections because the widest sections of the composite member 1 occur at the opposite wide faces 5 where the tensile and compressive forces are greatest. It is estimated that the composite wood member 1 produced according to the present invention has approximately twenty-five percent less wood volume but only about 12.5 percent less strength than a comparably sized board having a rectangular cross section.

Similarly, the wall studs 53 may also subjected to lateral forces acting in a direction normal to the composite member stud wide faces 5. Also, the wall studs 53 are subjected to downward compressive forces associated with portions of the structure supported thereby. Such downward compressive forces exert buckling forces against the studs 53 which act in a direction normal to their opposite wide faces 5. As with the floor joists 51, the cross-sectional configuration of the wall studs 53 is particularly adapted for efficiently resisting such buckling loads.

At the plane of intersection 46 of the composite wood member 1 thus subjected to a bending load, the tensile and compressive force components cancel each other out and the narrow faces 3 are subjected to a shear force. However, such shear forces are generally considerably less than the compressive and tensile forces. Therefore, the hourglass-shaped cross-sectional configuration of the elongated member 1 is particularly efficient for carrying such bending loads because the greatest widths are at the wide faces 5. Furthermore, the shear forces which reach their maximum at the planes of intersection 46 are effectively resisted by the glue joints thereat which are stronger than the wood comprising the elongated pieces 2. Therefore, in addition to being very efficient for resisting bending loads, the composite wood members 1 are very efficient at resisting shear loads.

It will thus be appreciated that the composite wood member 1 of the present invention may be utilized in place of a conventional board with a rectangular cross section in many applications. For example, conventional 2×4 studs for framing wall structures may be replaced by comparably sized composite members 1 having nominal dimensions across their wide faces 5 of two inches and between their wide faces 5 of four inches. Likewise, conventional 2×10 floor joists for framing floor structures may be replaced by comparably sized composite members 1 having nominal dimensions across their wide faces 5 of two inches and between their wide faces 5 of ten inches.

Because the radial faces 7 of the elongated pieces 2 comprise primarily vertical grain, the shrinkage rate along these faces will be approximately one half of the shrinkage rate which occurs along the narrow and wide faces 3 and 5 respectively comprising flat grain. Therefore, shrinkage across the radial faces 7 will be minimized and the effects of shrinkage across the opposite narrow and wide faces 3 and 5 respectively will effectively be canceled out. The elongated piece 2 of the present invention will tend to resist cupping and warping in the kiln drying step and also during any subsequent drying after bonding into the composite wood member 1 and its subsequent incorporation into, for example, the structures 49 and 50.

Conventional boards having rectangular cross-sections, on the other hand, are considerably more prone to warping and cupping because the opposite faces thereof may respectively comprise both flat and vertical grain wood having different shrinkage rates. The fact that wood shrinks in a direction tangential to its annular rings approximately twice as much as it shrinks in a direction radial to the annular rings accounts for the cupping tendancy to which almost all rectangular cross-sectional boards are subject. Therefore, distortion of the composite wood member 1 of the present invention within the structure 47 will cause considerably less damage thereto than shrinkage of comparably sized boards with rectangular cross-sections, their respective moisture contents being approximately equal. Also, as shown in FIGS. 4 and 5, the respective curvatures of the annular rings 23 of the respective elongated pieces 2 are concave with respect to their narrow faces 3 and are oriented in opposite directions. Therefore, warping and distortion of the individual elongated pieces 2 will effectively tend to be canceled out with the composite wood member 1 remaining substantially true and straight.

A further advantage of the composite wood member 1 over boards having rectangular cross sections is that defects in the elongated pieces 2, such as knots, will tend to be randomized in the elongated pieces 2 and the effect thereof with respect to composite wood members 1 lessened. With conventional rectangular cross-sectional boards, such defects are more likely to extend completely through such a board with a resultant weakening thereof. Also, in the practice of the present invention, a particularly bad defect in a log 21 could be isolated in an individual sector-shaped segment and discarded with the remaining sector-shaped segments 30 being substantially structurally sound.

FIGS. 6–8 show a composite wood member 101 comprising a modified embodiment of the present invention including elongated pieces 102 formed from a frusto-conical log. Since most logs have some degree of taper when harvested, a considerable amount of usable wood is typically wasted when the logs are rounded to a cylindrical configuration. The modified composite wood member 101 contemplates utilizing a frusto-conical log for further minimizing waste and maximizing the yield of composite wood members 101.

Radially cutting a frusto-conical log as heretofore described in connection with a cylindrical log yields pieces 102 with narrow faces 103, opposite edges 104, wide faces 105, opposite edges 106 and radial faces 107. Furthermore, each piece 102 has a large end 108 and a small end 109.

The pieces 102 have cross-sectional configurations comprising isosceles trapezoids 111 with apex sides 112, base sides 113 and radial sides 114 respectively. The cross-sectional trapezoids 111 of the pieces 102 decrease in size from their respective large ends 108 to their small ends 109, but the proportions remain substantially the same. The composite members 101 are formed by aligning the pieces 102 longitudinally with respect to each other with the large end 108 of one piece adjacent the small end 109 of the other piece. A suitable adhesive 145 is applied to one or both of the narrow faces 103 and the pieces 102 are bonded together at a plane of intersection 146 forming a glue joint at the narrow faces 103.

As shown in FIGS. 7 and 8, the cross-sectional configuration of the composite wood member 101 varies between its opposite ends, but the elongated piece wide faces 105 are substantially equidistant and parallel along the entire length of the member 101. Therefore, the modified composite wood member 101 may be substituted for conventional lumber in the same manner as the composite wood member 1. The structural performance of the modified composite wood member 101 is nearly equal to that of the composite wood member 1, and it may be produced at a relatively low cost since the waste resulting from its production is minimized, particularly in frusto-conical logs.

The composite wood members 1 facilitate installation of the fiberglass batt insulation 70 in the structure 47. The dihedral angles formed by the radial faces 7 thereof are adapted to receive and capture the insulation 70 and hold it in place either permanently or until another surface is applied or mechanical fasteners are used for attachment. Thus, the insulation 70 may be cut in widths which are slightly greater than the spacing of the floor joists 51, the wall studs 53, the ceiling joists 68 or the rafters 69. The strips of insulation 70 are then compressed and placed between the composite wood members 1 whereat they expand into contact with the respective wood member radial faces 7 and are captured thereby.

It is to be understood that while certain embodiments of the present invention have been described and shown herein, it is not to be limited to the specific forms or arrangements of parts herein described and shown.

What is claimed and desired to secure by Letters Patent is:

1. In a structure including a plurality of structural members, the improvement of a composite wood member which comprises:

(a) an aligned pair of elongated pieces, each said piece including:
  (1) a narrow face extending longitudinally in relation to said piece and having a transverse width;
  (2) a wide face extending longitudinally in relation to said piece and positioned in spaced relation to said narrow face, said wide face having a transverse width greater than said narrow face transverse width;
  (3) a pair of radial faces extending between said narrow and wide faces;
  (4) a transverse cross-sectional configuration substantially defining a trapezoid with an apex side at said narrow face and a base side at said wide face;
  (5) an arcuate, cross-sectional grain pattern concave with respect to said narrow face, said narrow face being generally in a plane parallel to a tangent of said grain pattern and having a flat grain pattern thereat;
  (6) said wide face being generally in a plane parallel to said tangent and having a flat grain pattern thereat; and
  (7) each of said radial faces being generally in a respective plane perpendicular to said grain pattern and having a respective vertical grain pattern thereat;

(b) said pieces being bonded together at said narrow faces at a plane of intersection between said wide faces with said wide faces extending substantially parallel to each other; and (c) said composite member being substantially symmetrical about an axis perpendicular to said wide faces.

2. The structure according to claim 1 wherein:

(a) said composite members comprise floor joists.

3. The structure according to claim 1 wherein:

(a) said composite wood members comprise wall studs.

4. The structure according to claim 1 wherein:

(a) said composite wood members comprise ceiling joists.

5. The structure according to claim 1 wherein:

(a) said composite wood members comprise rafters.

6. The structure according to claim 1 which includes:

(a) insulation placed between adjacent pairs of said composite wood members, said insulation abutting said composite wood member radial faces and extending into respective dihedral angles formed thereby whereby said insulation is retained between said composite wood members.

7. The structure according to claim 1 which includes:

(a) said pieces each having:
  (1) opposite large and small ends;
  (2) longitudinally tapered narrow faces;
  (3) longitudinally tapered wide faces;
  (4) longitudinally tapered radial faces;
  (5) said faces diverging toward said large end; and
  (6) said faces converging toward said small end;

(b) said pieces being longitudinally aligned with the large end of one said piece adjacent the small end of the other said piece and the small end of said one piece being adjacent the large end of said other piece;

(c) said wide faces being positioned in substantially equidistant, parallel planes.

8. In a structure with structural members including floor joists, wall studs, ceiling joists, and rafters, the improvement of each said member comprising:

(a) an aligned pair of elongated pieces having substantially identical configurations, each said piece being radially cut from a log and including:
  (1) a generally planar narrow face extending longitudinally in relation to said piece;
  (2) a generally planar wide face spaced from said narrow face;
  (3) a pair of radial faces extending between said narrow face and said wide face, each said radial face extending longitudinally in relation to said piece;
  (4) a transverse, cross-sectional geometry substantially comprising a trapezoid with an apex side at said narrow face, a base side at said wide face, a pair of radial sides, each of said radial sides being at a respective radial face;
  (5) an arcuate, cross-sectional grain pattern concave with respect to said narrow face;
  (6) said narrow face being generally in a respective plane parallel to a tangent of said grain pattern and having a flat grain pattern thereat;
  (7) said wide face being generally in a respective plane parallel to said tangent of said grain pattern and having a flat grain pattern thereat; and
  (8) each of said radial faces being generally in a respective plane perpendicular to said grain pattern and having respective vertical grain patterns thereat;

(b) said narrow faces being adhesively bonded together along the length of said member in mutually abutting relationship at a flat glue joint having a greater strength than the wood comprising said member and lying in a plane of intersection between said wide faces whereby said wide faces comprise opposite faces of said member and corresponding radial faces of each said piece forming a dihedral angle with respect to each other;

(c) the transverse, cross-sectional geometry of said composite wood member being substantially symmetrical about an axis extending in a direction normal to said wide faces; and (d) when said composite wood member is subjected to a bending load acting in a direction normal to its wide faces said composite wood member being subjected to a maximum compressive force component of said bending load at one said wide face and a maximum tensile force component of said bending load at the other said wide face, said compressive and tensile components tending to cancel each other out at said plane of intersection whereat a respective shear force component of said bending load is at its maximum.

9. The structure according to claim 8 which includes:

(a) insulation placed between adjacent pairs of said wall studs and said ceiling joists, said insulation abutting said composite wood member radial faces and extending into said dihedral angles formed thereby whereby said insulation is retained between said composite wood members.

10. A composite wood member which comprises:

(a) an aligned pair of elongated pieces having substantially identical configurations, each said piece being radially cut from a log and including:

(1) a generally planar narrow face extending longitudinally in relation to said piece;

(2) a generally planar wide face spaced from said narrow face;

(3) a pair of radial faces extending between said narrow face and said wide face, each said radial face extending longitudinally in relation to said piece;

(4) a transverse, cross-sectional geometry substantially comprising a trapezoid with an apex side at said narrow face, a base side at said wide face, a pair of radial sides, each of said radial sides being at a respective radial face;

(5) an arcuate, cross-sectional grain pattern concave with respect to said narrow face;

(6) said narrow face being generally in a respective plane parallel to a tangent of said grain pattern and having a flat grain pattern thereat;

(7) said wide face being generally in a respective plane parallel to said tangent of said grain pattern and having a flat grain pattern thereat; and (8) each of said radial faces being generally in a respective plane perpendicular to said grain pattern and having respective vertical grain patterns thereat;

(b) said narrow faces being adhesively bonded together along the length of said member in mutually abutting relationship at a flat glue joint having a greater strength than the wood comprising said member and lying in a plane of intersection between said wide faces whereby said wide faces comprise opposite faces of said member;

(c) the transverse, cross-sectional geometry of said composite wood member being substantially symmetrical about an axis extending in a direction normal to said wide faces; and (d) when said composite wood member is subjected to a bending load acting in a direction normal to its wide faces said composite wood member being subjected to a maximum compressive force component of said bending load at one said wide face and a maximum tensile force component of said bending load at the other said wide face, said compressive and tensile components tending to cancel each other out at said plane of intersection whereat a respective shear force component of said bending load is at its maximum.

11. The composite wood member according to claim 10 which includes:

(a) said plane of intersection being positioned substantially equadistant from and parallel to said parallel planes including said wide faces; and (b) said member having an hourglass-shaped, uniform, longitudinally continuous, transverse cross-sectional geometry with said wood member being substantially symmetrical about said plane of intersection.

12. The composite wood member according to claim 10 which includes:

(a) said pieces each having:

(1) opposite large and small ends;

(2) longitudinally tapered narrow faces;

(3) longitudinally tapered wide faces;

(4) longitudinally tapered radial faces;

(5) said faces diverging toward said large end; and (6) said faces converging toward said small end;

(b) said faces being longitudinally aligned with the large end of one said piece adjacent the small end of the other said piece and the small end of said one piece being adjacent the large end of said other piece; and (c) said wide faces being positioned in substantially equidistant, parallel planes.

* * * * *